United States Patent [19]

Bonnet et al.

[11] 4,304,020

[45] Dec. 8, 1981

[54] INSTALLATION FOR SHOE PRODUCTION

[75] Inventors: Pierre Bonnet, La Brisce; Remy Villaret, both of 61, rue du Moulin, Miramont de Guyenne, France, 47800

[73] Assignees: Remy Villaret; Pierre Bonnet; Etablissement G. Imbert, all of Miramont de Guyenna, France

[21] Appl. No.: 69,555

[22] Filed: Aug. 24, 1979

[30] Foreign Application Priority Data

Sep. 6, 1978 [FR] France ..... 78 25591

[51] Int. Cl.[3] ..... A43D 0/00

[52] U.S. Cl. ..... 12/1 A

[58] Field of Search ..... 12/1 A, 1 R

[56] References Cited

U.S. PATENT DOCUMENTS 2,960,703 11/1960 Dorosz ..... 12/1 A 3,631,553 1/1972 Holland ..... 12/1 A 3,858,263 1/1975 Smirnov et al. ..... 12/1 A

*Primary Examiner*—Patrick D. Lawson

*Attorney, Agent, or Firm*—Browdy and Neimark

[57] ABSTRACT

Shoes with bonded type soles may be made at a higher rate of speed on a line with continuous travel of the lasts, at a predetermined and variable rate, where the series of automatic machines come, in most cases, to work on the last. Either a complete installation, with automatic, programmed cycle, or a series of automated units particularly make possible: placing of the insoles on the last with foot and size selection and centering of the insoles; simultaneous gluing and assembly of the sides after placing of the uppers; roughing operations with preregistration of the depth and following of the profile of the sides; overturning of the sole, prepositioning on the upper, reactivation of the glue, attachment and bonding of the sole; and removal from the last. The installation may be used for the production of various types of shoes by units assembled by unit in pairs or by pairs.

18 Claims, 20 Drawing Figures

INSTALLATION FOR SHOE PRODUCTION

Field of the Invention

This invention relates to the field of shoemaking and more particularly to the making of shoes with bonded soles whose various parts are assembled, mounted and shaped on a last. It relates very particularly to a production installation in which all parts of the traditional work stations have been automated.

BACKGROUND OF THE INVENTION

It is known that making a shoe in a production-line factory comprises a great number of operations requiring labor that is considerable and highly specialized for certain stations. These operations can be broken down into three main groups: cutting of the various constitutive pieces such as insoles and uppers; stitching phases; and assembly and finishing. Although the first two stages have been the object, so far, of thorough automation by use of improved machines, with relatively reliable operation and permitting good work rates, such as not been the case for the shoe assembly phases.

Briefly, these assembly operations and subsequent finishing of a bonded type shoe can be listed as follows on a traditional line where the base lasts are set and around which the various operations are performed: selection of the insole corresponding to the foot and size; centering and then attaching the insole on the last; curving the counters; assembly of the toes; assembly of the sides; assembly of the boxing (back part of the shoe); removal of the fastening clamps; successive roughing of the parts to be glued; gluing of the uppers mounted on the last; gluing of the outsole (generally obtained by injection of polyvinyl chloride or the like) and putting on the line; reactivation of the glue on the soles and uppers; positioning of the soles on the uppers; attaching, bonding under pressure; possibly cutting of false laces and removal of the shoe from its last; varnishing the shoe, generally by spray gun; drying; checking of the finished shoe; putting in boxes (generally made next to the line); stamping of the size and various distinctive markings; packaging; hooping; storage; and shipping.

In a shoe factory, such an assembly-finishing line requires the labor of about 15 persons, of which more than half are highly specialized and who have to make frequent manual interventions. This is done for an average hourly production of about one hundred pairs of shoes.

To try to remedy these drawbacks of long training of personnel, to reduce costs and to improve the manufacturing quality, it has already been proposed to supply different work stations and assure transfer and removal of semifinished or finished items by production lines allowing semiautomatic or automatic making of shoes. According to a first known group of transfer lines, essentially of Italian and Soviet origin, the line is made of a series of carriages operated for step-by-step advance along a given route, for example, polygonal, the carriages carrying lasts which, with some exceptions, are stationary and directed perpendicularly to the direction of the movement of the carriages; thus, the machine heads move along the line to come to work on the immobilized last. Various drawbacks have already been emphasized for this type of installation; in particular, there has been brought out the need of having relatively long periods of stopping for certain operations (for example, gluing or pressing) which leads to adopting advancement steps of long duration for the carriages and results in hourly productions that are considered insufficient, for example, on the order of 60 to 70 pairs of shoes. To remedy these drawbacks, there was then proposed a transfer line in which the last-carrying carriages are automated, i.e., provided with couplings-uncouplings and variable speed systems and where the lasts can be put into rotation in different directions as a function of the type of work machine. Thanks to its possibilities, such a line can make it possible to gain time in certain operations but, besides complexity in the technical embodiment of the carriages and their movement, it still requires the intervention of specialized labor for a series of manual adjustments, particularly depending on the size types.

SUMMARY OF THE INVENTION

One of the objects of the present invention is to propose an installation for transfer by carriages with a new design with reliable functioning and making higher work rates possible.

Another object of the present invention is to provide an almost totally automated installation for making shoes of the bonded type in which personnel can be cut to a fifth of what is usually used in a traditional line and resulting on the one hand, in an improvement in the quality of the finished products and, on the other hand, in a productivity notably greater than that of the automated lines discussed above.

According to another object of the present invention, the invention aims at making an evolutionary line, i.e., able to replace, in the standard production line, certain manual work stations with automatically operating machines. This is achieved thanks to the insertion of automated modules in all or part of the traditional line now used by shoemakers.

These various objects are achieved, in their most elaborate form, by an installation automated as a whole, according to the present invention, which essentially comprises, arranged along and around a line where suitable base lasts travel in line:

(a) means for placing the insole on the lasts, with automatic selection of the foot and size, then centering and fastening on said lasts;

(b) means intended for placing of the upper and assembly of the toes from a supply magazine at a constant higher level;

(c) automatic means of gluing and assembling the sides;

(d) after gluing and hammering down the uppers to the level of the heel (or "boxing" ), automatic means making it possible to level down or "rough" on the last the folds of the toes, backs and sides with preregistering of the depth of the roughing and electronic feeling of the profile of the sides;

(e) after brushing then gluing of the roughed surfaces and placing of the glued soles on the line, automatic means successively making possible: turning over the sole, prepositioning then centering of the sole on the upper which is still held on the last, reactivation of the glue, fastening and then bonding of the sole; and (f) a series of means intended to remove the last, preparing it for the following cycle then grasping and transporting the shoe which, after varnishing and checking, is put in a box and is ready for shipment.

All of the operations are performed continuously, with safety systems during the programming, on a series of relocatable carriages forming an endless line in which the lasts, placed on the wrong side, are stationary during the use of said means except during the phase of assemblying the toes.

According to a characteristic of the present invention, the relocatable carriages are made up of plates comprising: in the median part, two series of articulated supports for fastening a pair of lasts; on each side of the supports, places for putting two soles of different feet; at the level of an edge two cams at a distance, one intended to control the change in size, the other the detection of an insole for right or left foot; at the level of the opposite edge, two spaced pins making possible the routing of the automation signals to the plates of each work station.

In practice, each of the new means mentioned above corresponds to an automatic machine without manual intervention, which can be incorporated alone or with others, according to the present invention, in a traditional shoemaking line.

Before undertaking a more detailed description of the essential organs and functioning of the various work stations, there will be indicated below the main characteristics of the devices suitable for being used in a line according to the present invention.

Means (a) are made up of a unit comprising: a rotating circular magazine for feeding insoles with automatic functioning by a robot provided with n compartments, at constant level, for n sizes, each compartment being double to carry a stack of insoles for the right foot and a stack of insoles for the left foot; a flexible tube with a suction nozzle to place an insole on the last; lateral feeler arms working with clamps and a vertical support rod to perform centering of this first insole on the last; vertical pneumatic hammers intended to fasten the insole on the last, previously provided with two barbs, without having to put in staples or tacks; said cams of each plate of the carriage for detection of the insole type and changing the size being selectively operated by stationary feelers, integral with the carriage frame, according to the shape given on an electropneumatic control panel.

Means (b) are made of a combination of clamps and a grasping device of the last, making possible:

raising of the last above the plate, grasping and pivoting it 90 degrees, placing of the upper and toe assembly of the shoe being done by a machine of a type known in itself but supplied by a rotating circular magazine of uppers, at constant level, provided with n compartments corresponding to n different sizes, and each compartment being double to carry stacks for the right and left foot and placing of an upper being programmed to fit the insole already attached.

Means (c) corresponds to a unit, automatic machine for gluing and hammering or "assembling" the sides, essentially comprising: piping for supplying thermofusible glue; a set of articulated pneumatic pistons whose ends rest, at a programmed rate, on the contours of the lasts by means of a protective skirt; and a device for sending hot air to soften the sides; said machine making it possible simultaneously to glue and assemble sides of two lasts corresponding to a pair of shoes of a given size.

Means (d) are made up of a unit successively comprising: a device for preregistering the depth of roughing; a station for grinding the roughing by abrasive belts; a station for roughing the toes and backs with reversal of the direction or rotation of the belts driving an abrasive wheel; a double station (for a pair) for side roughing of the sides equipped with an electronic copier with a proximity detector making it possible to follow the edge of the last and thus eliminate using patterns.

Means (e), after turning over of the sole as will be explained below, are made up of an entirely automated machine comprising: a unit for centering and fastening the sole on the last with a system for automatic recording of the length of the shoe and sole height; heating means for reactivation of the glued upper and sole; a bonding press equipped with a flexible membrane enveloping the shoe, this latter being held firmly between rubber clamps during bonding to avoid bursting said membrane.

The centering unit with system for automatic recording of the dimensions (length and thickness) of soles comprises at least two series of jacks with controlled locking-unlocking and coordinated actions, these jacks being solid with clamps and/or nozzles for positioning and holding the last.

Finally, means (f) for removing the shoe from the last essentially comprises: an instrument for swinging the last backward; clamp-hammer combination making it possible to pull the shoe then the heel by lifting it and facilitate the push by pressure; and a multiple clamp device for grasping the shoe, with swinging of this latter by 90 degrees, and placing the shoe on a conveyor belt and then for making the shoe undergo polishing-varnishing operations, inspection-control and packaging.

According to an advantageous embodiment of the present invention, the plates carrying the last are translated by a step-by-step movement on the lengthwise members of a frame along two horizontal paths located in two different planes, namely, a first path for traveling along to the work stations corresponding to means (a) to (e) to the stage of gluing the roughed surfaces and the soles, then a second path located under the first and during which drying and evaporation of the glue occur, transfer of the plates downward, at the end of the path, being performed on a level changer provided with a plate and plate guides and a plate descent jack.

In production installation where most of the work stations are automated according to the embodiment of the groups of means mentioned above, each station operates on a single last of a plate, except for assembly of the sides where the work is done in pairs, and at the end of the circuit a shoe for each foot corresponding to a given size is obtained; packaging is then done by pairs.

According to a variant embodiment, one or more stations with an automatic assembly machine can be doubled to work simultaneously, as in the case of assemblying sides (means c), on two lasts placed on a plate to cause shoes to come out in pairs at the end of the line.

BRIEF DESCRIPTION OF THE DRAWINGS

The invention will be better understood from the detailed description of some non-limiting embodiments, shown by the accompanying drawings which show schematically.

DETAILED DESCRIPTION OF PREFERRED EMBODIMENTS

Figure 1:
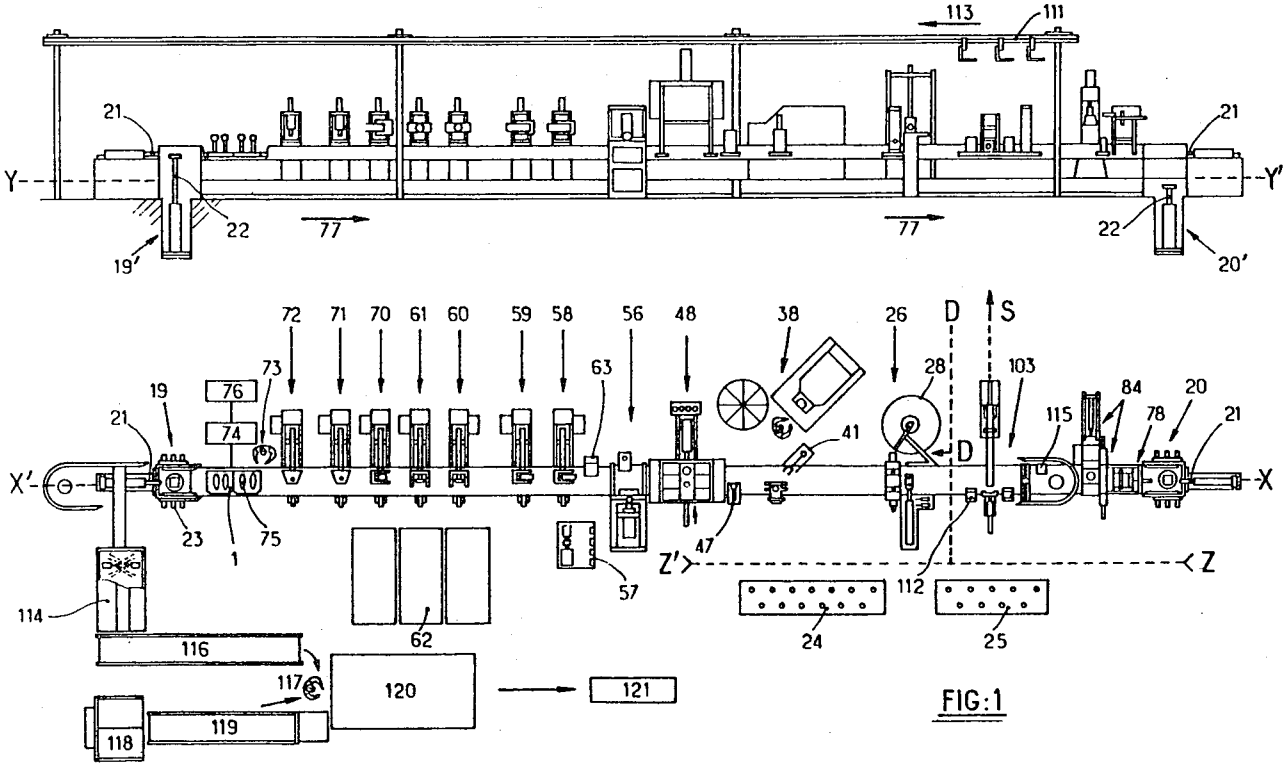
FIG. 1—a unit for automatic assembly of shoes according to the main object of the present invention.

Although, as stated hereinabove, the invention is not limited to a complete installation with automatic or semi-automatic running as shown in FIG. 1 and also has for its object any of the automated machines of the principles illustrated in the other figures and suitable for being introduced, as a module, in a standard manual line, the description below will refer essentially to the entire automated line with details, for each of the original phases, relating to the various figures of the other drawings.

In a line of the type of FIG. 1, the conveyor carriages which continually serve the operating line of work stations follow the following path: a first path XX' on the outside of the support frame opposite the work stations, then, after automatic descent of the carriages as will be explained below, a second path YY' made under the first inside the same support frame and during which the glued items undergo a drying, reascent of the carriages then being performed automatically to return to the surface, and again following line XX'.

Figure 2:
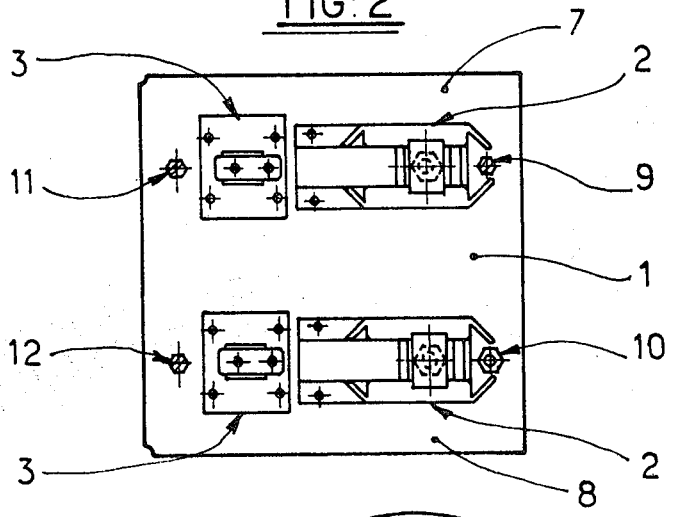
FIG. 2—a representation in plan view of the structure of a plate or carriage plate.
Figure 3:
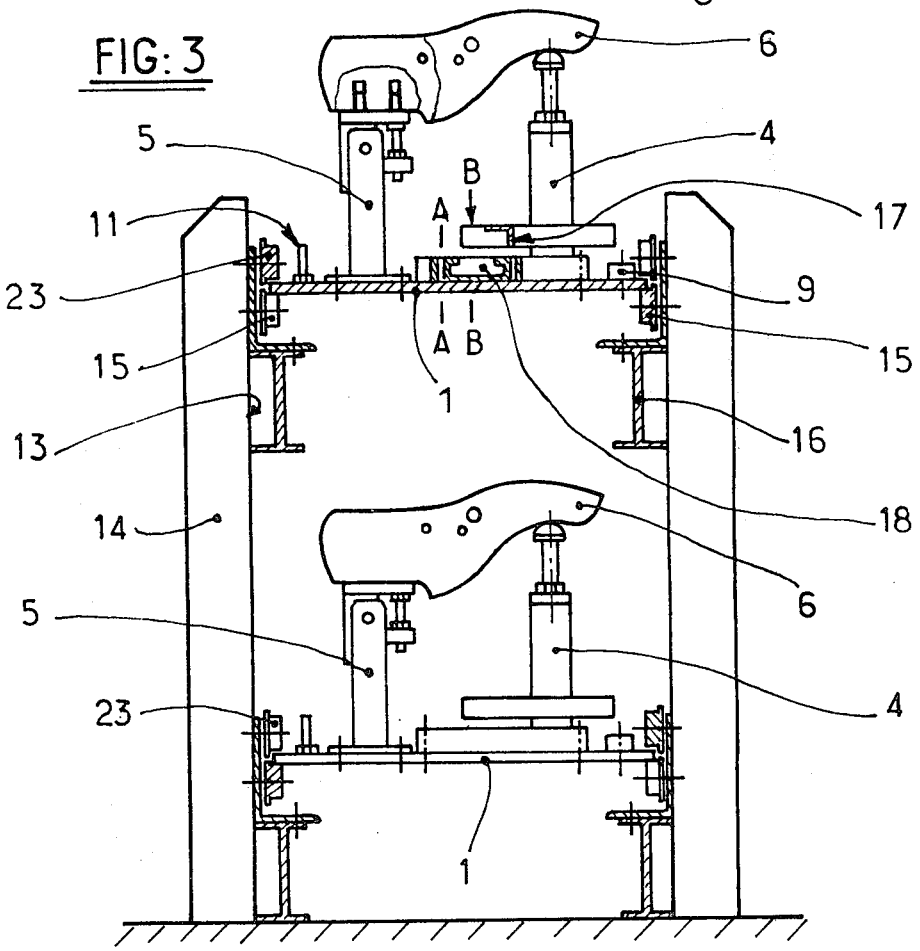
FIG. 3—a section of the transfer operation of a plate at the end of the line.

Each conveyor carriage is made up, as can be seen in FIGS. 2 and 3, of a plate 1 of the metal plate type provided with supports 2, 3 intended to fasten piston turrets 4 and 5 which act to support and hold in place last 6 on which all the shoe assembly operations will be performed. Each carriage comprises two lasts 6 and has open spaces 7 and 8 on which outsoles are placed at a given stage of the line. Further, according to a characteristic of the present invention, each carriage comprises, on one of its edges directed toward the heads of the main work machines, two cams 9 and 10 which serve to control either detection of an outsole or insole for the right or left foot (cam 9) or change of size (cam 10), and, on the opposite edge, two pins 11 and 12 making it possible to control switching of the automation signals to the plates of each work station.

These carriages are of the step-by-step advance type and move on members 13 of a frame 14 by means of wheels 15 supported by an angle iron 16 of the IPN type. According to a variant not shown here, each plate is supported and put in movement by a series of crosswise rollers (for example three or four per plate) whose shaft bearings travel on slide paths provided along and inside members 1. It will be noted that hatched elements 17 and 18 correspond respectively to the representation of the sections BB and AA indicated in the upper part of FIG. 3.

The operation of transferring a carriage, i.e., its descent into frame 14 after path XX' to take path YY', then its ascent in the opposite direction to resume line XX', is shown in FIG. 3 and locations 19, 19' and 20, 20' of the general diagram of FIG. 1. Piston (or plate) 21 recoils to disengage a separation support provided between two plates 1 and then, while jack 22 rises to support the plates, guides 23 of the carriage are recalled to clear frame 14 of the carriage, the plate descends (lower position of FIG. 3) and plate 21 and guides 23 return to their place for the following operation, these phases being of the same type for raising the plate to the upper level at location 20' (FIG. 1). These transfers are performed at regular or irregular intervals depending on the advancing speed of the carriage and are automatically controlled from general panels 24 and 25. With the exception of the work station involving placing of the uppers, at least in the non-limiting example of FIG. 1, lasts 6 remain stationary on plates 1 and the machine heads come to perform the work on them.

There will now be described in detail the sequence of complete operations of assembling a shoe from the starting point marked D on the line to leaving of the assembled shoe designated by letter S.

Figure 4A:
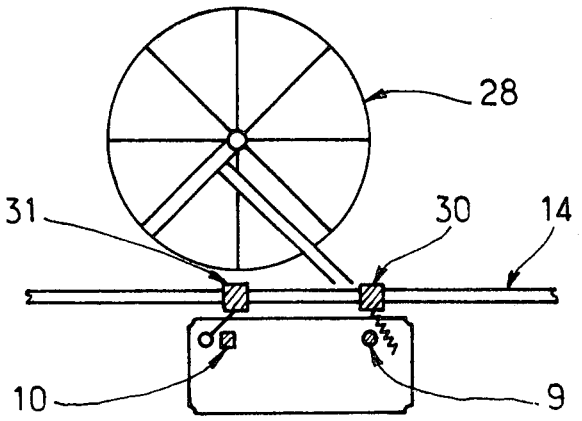
FIGS. 4*a* and 4*b*—operating principle of the apparatus performing the distribution of insoles and plating them on the last (centering and attaching)
Figure 4B:
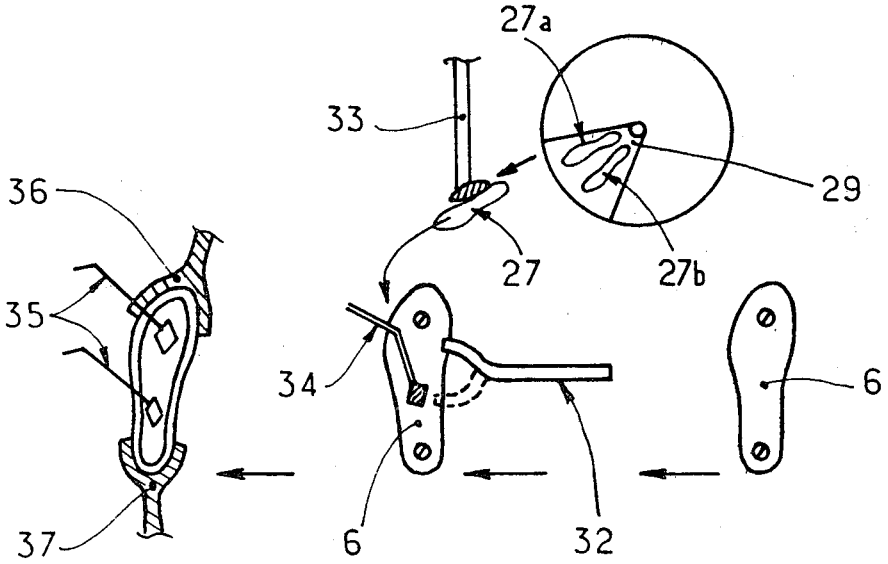

The first operation consists in placing and fastening the insole on the last, performed by the automatic unit 26 (FIG. 1) and schematized in FIGS. 4*a* and 4*b*. Feeding of insoles 27 is done by means of a circular magazine 28 divided into a series of double compartments 29 (for example, eight for eight different sizes) each of which contains right foot soles 27*a* and left foot soles 27*b*. The magazine is at a constant higher level and selectively distributes, thanks to pins 30 and 31 fastened on frame 14 and which make contact with cams 9 and 10 of the plate, an insole either for the right foot or left foot and a given size corresponding to the desired final shoe. When it is desired to assemble three successive pairs of shoes of the same size (for example, size nine and a half, the most popular), cam 10 for changing size is removed from the carriage. While last 6 is held firmly by claws or clamps 32 an insole 27 is placed on the last by a suction piping with a nozzle 33 then centered on the last particularly with a support rod 34. The automatic device then performs attachment, i.e., the final fastening of insole 27 on last 6 by means of a blow with hammers 35 while the last is firmly held by front and back clamps 36 and 37.

Figure 5:
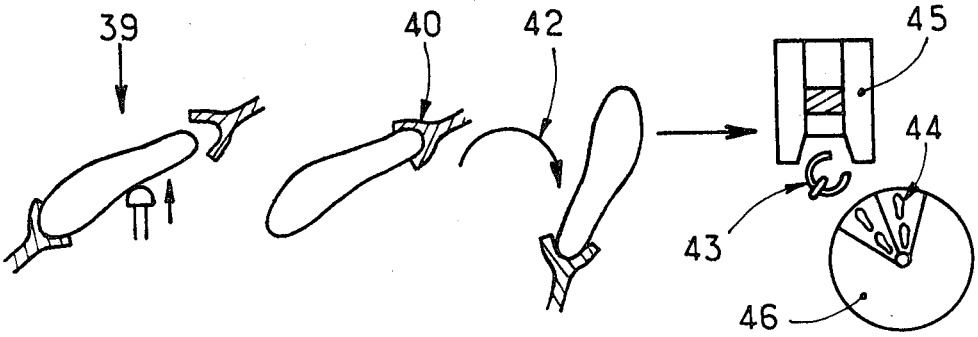
FIG. 5—a schematic representation of the operations of removal from the last, pivoting of the latter, supply and placement of uppers.

The second operation corresponds to placing the upper on the last and is indicated by the general number 38 in FIG. 1. In the embodiment shown here, the last is removed from its support according to the phases of FIG. 5, namely, raising of the last at 39; grasping of the last by clamps 40 of a gripping device 41 with robot arms; pivoting 90 degrees according to 42, then presentation to a manual operator 43 who assembles uppers 44 with a machine 45 of known type, itself fed by a circular magazine 46 at a contant upper level and arranged according to the same operating principle as magazine 28 for insoles, so that the operator always has within his immediate reach the upper of the foot and size corresponding to the insole on the last which has just been placed on the plate serving machine 45. A hammer system 47 (FIG. 1) then drives the upper onto the last.

Figure 6:
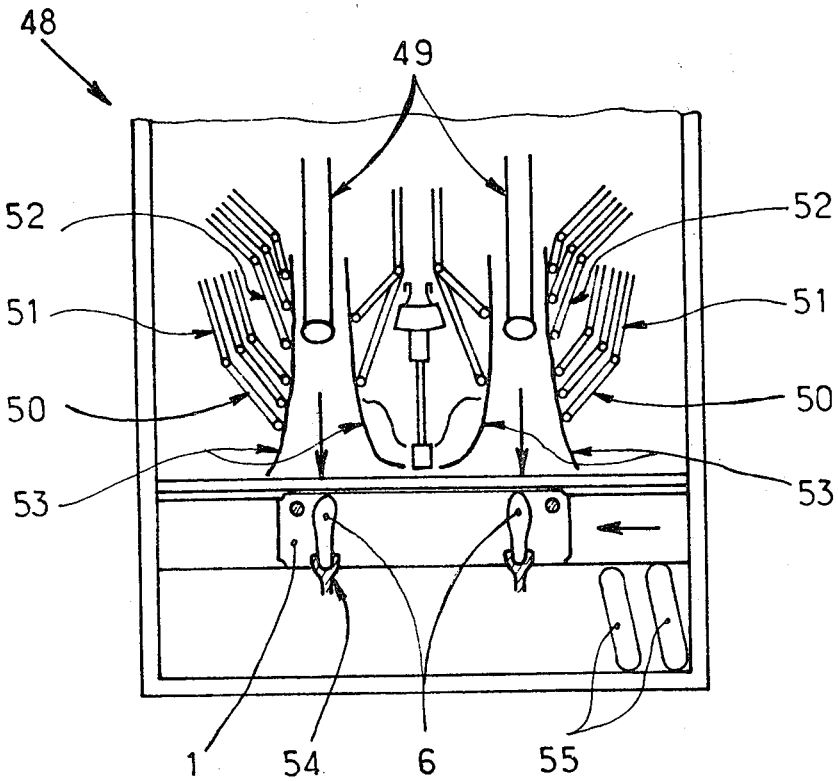
FIG. 6—principle of the machine for gluing and assembly of the sides.

Then comes the phase of gluing and hammering down or "assembly" of the sides, indicated by numeral 48 in FIG. 1 and performed by a totally automated original machine whose structure and principle are successively schematized in FIG. 6. This machine performs simultaneous gluing and assembly of a pair of sides, i.e., work on two lasts 6 of the same plate or carriage 1. It comprises as essential parts: glue supply piping 49 equipped with flexible arms for depositing the glue on the uppers (not shown); multiple series of press pistons (50, 51, 52 . . . etc.) whose heads make it possible to hammer down at each point the glued ends of the sides of the upper on the upper part of a last. These heads are isolated from lasts 6, provided with their upper, by intermediate skirts 53, for example, of leather or other flexible material to distribute the pressure forces and not damage the uppers. The machine descends on the lasts of the plate to perform its work, the lasts being solidly held by clamps and jaws (54, etc.) during the hammering down. Further, the machine is provided with piping 55 for blowing hot air to soften the sides before said operation.

In the fourth operation, symbolized by number 56 in FIG. 1, the boxing phase is performed, i.e., gluing the uppers at the level of the heel, made by a machine of known type but made automatic by programmed movement of the head passing over the last. Number 57 corresponds to the hydraulic drive unit of said machine and is normally located below it.

The side roughing operations then follow, which are performed on a series of four stations, namely: grinding (58) for the front ends with an endless belt grinder of emery cloth or the like; roughing of the back and front ends (59) with reversal of the direction of rotation of the grinder driving belts; two side roughing machines (60,61) for each foot forming a pair of a carriage. All these devices also operate automatically and are accompanied by one or more dust removers 62 to catch the fines from the roughing.

Figure 7:
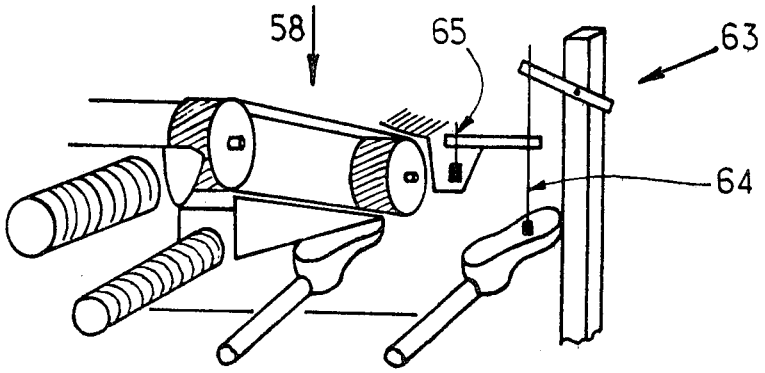
FIG. 7—preregistration of the depth of roughing at the moment of grinding operation.
Figure 8A:
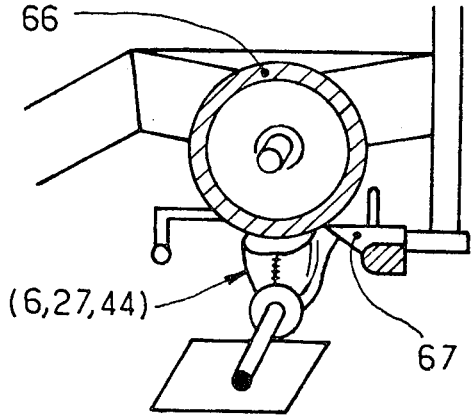
FIGS. 8*a* and 8*b*—simplified views of lateral roughing of the sides with electronic device for following the outline of the sides.
Figure 8B:
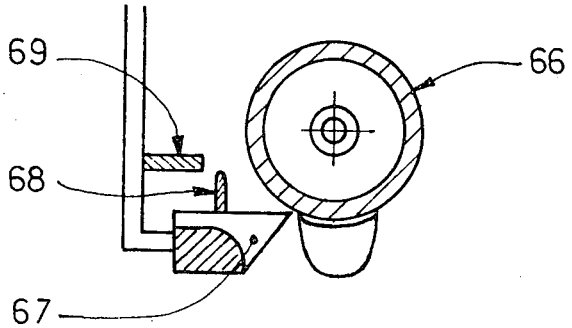

According to a preferred feature of the present invention, illustrated in FIG. 7, the roughing machine 58 is preceded by an electromechanical device 63 provided with a depth probe 64 and level rods 65 intended to preregister the exact level of roughing to be performed to obtain the optimal result. According to another preferred feature shown in FIGS. 8*a* and 8*b*, grinders 66 of side roughers 60 and 61 are equipped with a copier or electronic feeler 67 hollow in shape whose tapered end can follow perfectly the contours of the side to act as a guide for the action of grinder 66. During each contact of rod 68 of this copier with a proximity detector 69, the distance of separation between the end of the copier and the contour of the last is changed and thus it is possible, thanks to a good sensitivity of the device, to fit at all points the conformation of the upper on the last.

After brushing at 70 of the roughed parts and simultaneous aspiration of the dust by 62, with two inclined rotating brushes each working on a side, a gluing of the sides is performed on machines 71 and 72 for later attachment of the soles.

The following operation, shown manually in FIG. 1 by an operator 73 but able to be automated, consists of gluing 74 of the (outer) soles 75 coming from fabrication 76. The glued soles are placed, heel on the plate, on the two locations provided (one right foot and one left foot) on each carriage 1.

Thus there is reached, according to the embodiment of the line shown in FIG. 1, the end of first line XX' where there occur the timed transfers of the carriages at 19 into the lower part of the frame, as previously explained (lower position of FIG. 3). As shown in the upper diagram of FIG. 1, the carriages travel in the direction of arrow 77 along line YY' without the uppers mounted on the last and the soles undergoing any operation; this transfer time is intended for drying of the glue and can be programmed for variable time cycles depending on the desired production rate. At the end of line YY' each carriage is brought up into the working position (numbered 20, FIG. 1).

Figure 9A:
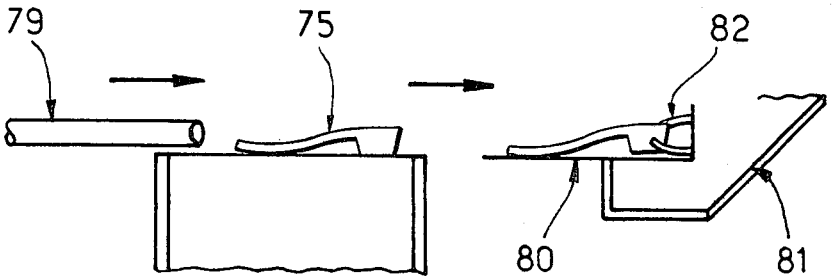
FIGS. 9*a* to 9*c*—operations of the device making possible the overturning of the sole before it is put on the last provided with the roughed and glued upper.
Figure 9B:
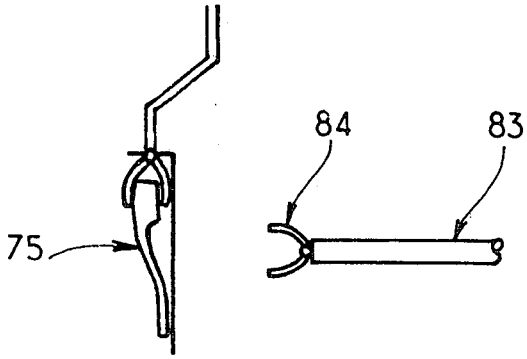
Figure 9C:
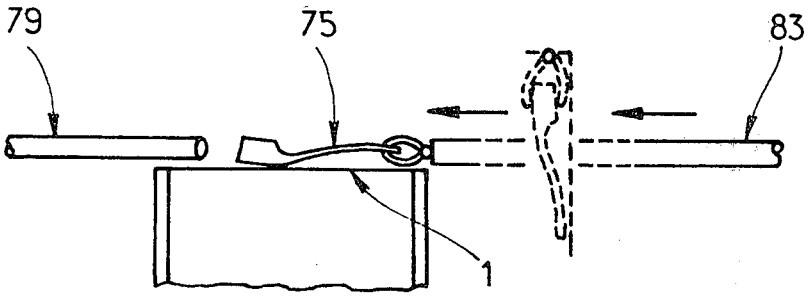

The following operation, which occurs at 78 and whose principle is schematized in FIGS. 9*a* to 9*c*, consists of a clever system of turning the sole upside down for the following operation where the sole must be with the heel side up. According to the process, sole 75 is first shoved by a jack arm 79 onto platform 80 with an articulated arm 81, provided with a pair of clamps 82 which grasp the heel.

Platform 80, behind which a piston 83 provided with clamps 84 is ready to intervene, then swings to the vertical position (FIG. 9*b*), the sole then being suspended; piston 83 then advances toward the carriage and causes the turning over of the sole when the upper end of the sole reaches plate 1 (FIG. 9*c*).

Figure 10A:
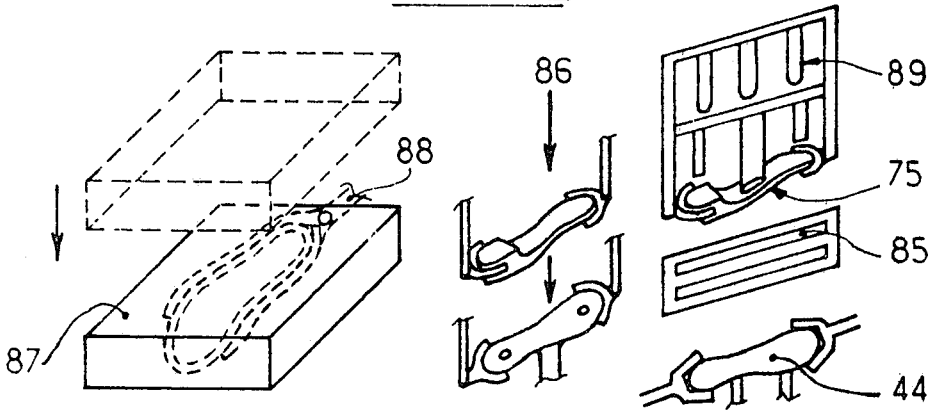
FIGS. 10*a* and 10*b*—broken views illustrating the structure and principle of operation of the automatic unit performing prepositioning and centering of the sole in the last, reactivation of the sole and last with upper, attachment of two said elements, then bonding of the shoe.

After turning the sole over, a series of operations is performed on machine 84, automated with programmed sequence and shown in FIG. 10*a*, namely: centering of sole 75 on the last provided with its upper; raising of the sole above the carriage, reactivation of both sole 75 and upper on the last (6,44) thanks to a heating ramp 85, for example, overloaded lamps or similar system; attachment (86) of the sole to the upper; and, finally, bonding operation performed in press 87 which is applied to the last held by rubber clamps 88 and which, in a way known in itself, works by use of an elastic membrane enveloping the shoe during the pressing.

Figure 10B:
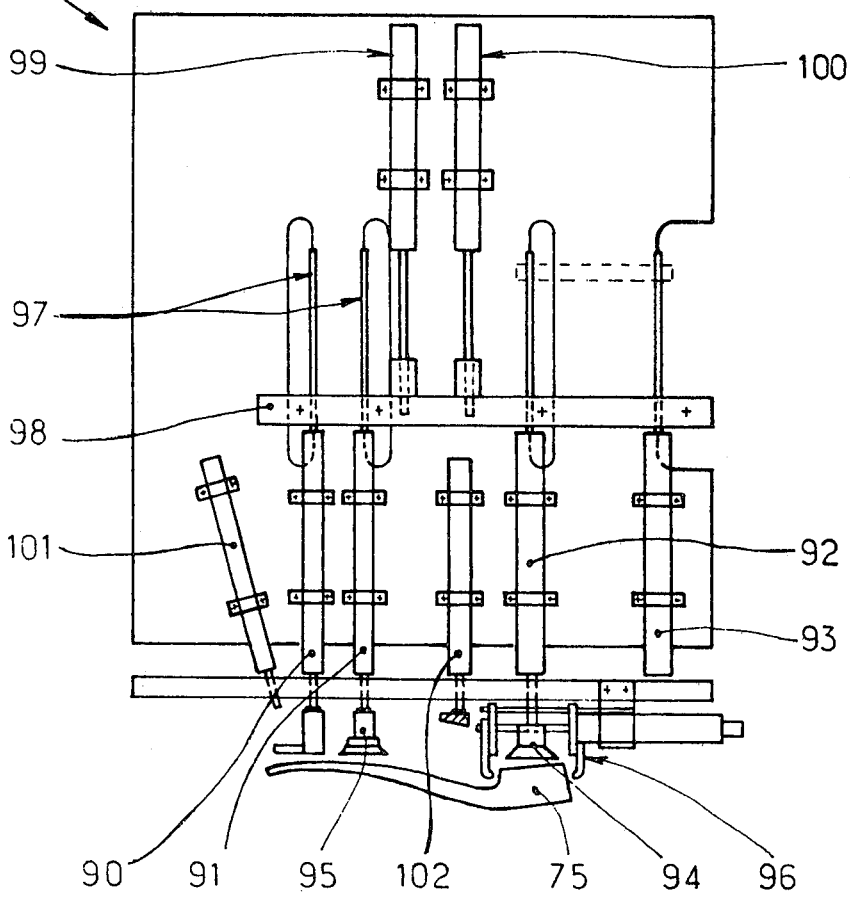
Figure 11A:
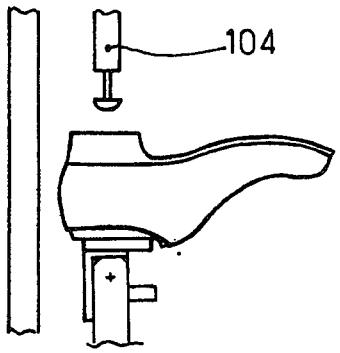
FIG. 11—diagrams showing the principal phases of removal of the shoe from the last and transporting it to the final finishing operations.
Figure 11B:
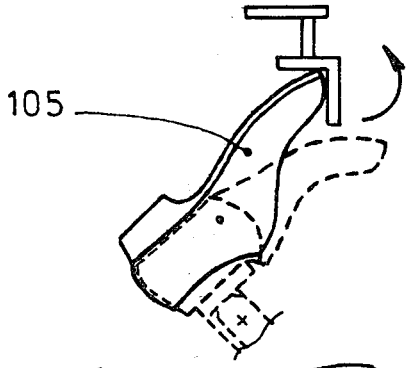
Figure 11C:
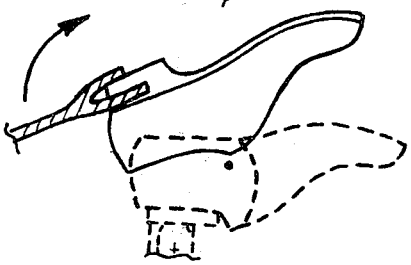
Figure 11D:
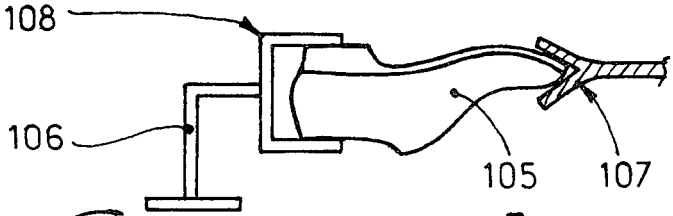
Figure 11E:
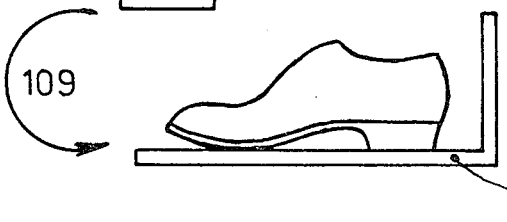

According to another original characteristic of this automatic unit 84, a recording is made of the length of the last (with upper) and the height of elevation of the sole after centering of the sole on the last and before slackening of the first on the second. This operation is performed thanks to device 89 illustrated in FIG. 10*b* and which operates as follows: four double rod jacks 90 to 93 descend on sole 75 and aspirate the latter by nozzles 94, 95, then causing closing of clamps 96; rods 97 of these four jacks are then locked by a brake at 98 by suppression of the pneumatic pressure and the unit is raised by two jacks 99 and 100. At this moment, reactivation occurs by heating at 85 (FIG. 10*a*) as explained above. Then jacks 99, 100 redescend and placing of sole 75 on the upper (operation 86, FIG. 10*a*) occurs, the four rods 97 are unlocked, aspiration by vacuum is shut off and clamps 96 are opened to release the sole. Jacks 101 and 102 constitute support organs for the end of the sole and for the instep.

After the shoe is bonded, it is time to release it from the last and prepare the last for a new assembly cycle. An automatic unit symbolized by 103 in FIG. 1 makes it possible successively to perform the following series of operations, illustrated by the scheme of FIG. 11: after position (a) with the point of support of piston 104 on the heel, the shoe is swung backward at (b), the upper is removed and the last is opened at (c), this latter remaining on its carriage plate, then the shoe 105 is grasped by robot arms 106 provided with front and back clamps 107, 108, and which, after turnover (109), place the shoe on plates 110 of an overhead conveyor 111. The last is then closed (number 112 of the FIG. 1) and is ready for a new cycle of shoe assembly, from D (FIG. 1), according to the sequence of operations just described.

It then suffices to proceed to the finishing and checking operations before storage and shipment of the shoes thus produced. To do this, according to the embodiment shown in FIG. 1, the shoes are sent by overhead conveyor 111 in the direction of arrow 113 into a varnishing booth 114 where each shoe, placed on a support and held by a gripper, is subjected to the action of nozzles mounted on rotating arms which uniformly distribute varnish over the entire surface. After varnishing, it is advisable to perform a brushing and cleaning of the upper, which, for example, can be performed at 115 before exit of the shoe and its overhead transport.

After varnishing with quasi-instantaneous drying, the shoes arrive in pairs on a conveyor belt 116 where they are checked. An operator 117, who receives boxes made by shaping and fastening machine 118 and transported by belt 119, does the packaging at 120, the shoes then being stored and sent to shipping 121.

An automatic line, corresponding to the scheme of principle of FIG. 1 was made by using a 80 56-cm plates for a total length of about 26 meters. Such a line operates with extremely reduced personnel, that can vary from 1 to 3 persons instead of 14 to 15 persons normally necessary for a traditional assembly line. Further, the quality of the finished products is superior, thanks to the elimination of human errors and/or imperfections and the production rate is increased, which is generally between 90 and 120 pairs of shoes per hour.

These results are obtained thanks to development of a series of entirely automated machines, such as, for example, those corresponding to work stations 26, 48, 56 to 72, 84 and 103 (see FIG. 1) and to the synchronization of the groups of apparatus, provided with safety devices in case of untimely stops or for checking, operated by display panels 24, 25.

Of course, the invention is not limited to this type of purely illustrative embodiment which can have variants or use equivalent means. For example, certain manual stations such as those indicated as 38 and 73 can be automated. Moreover, the automatic stations can be doubled so that each machine (as is the a case for assembly of sides at 48) can work on a pair at the same time. According to an improvement, it is wise, when the ambient temperature along the line is above 25° C., to assure air conditioning by sending cold air over a part of this latter inside the frame for the travel of the carriages, for example, along path Z–Z' in FIG. 1. According to a variant, the overhead conveying operation 111, 113 can be eliminated and replaced by sending the shoes directly at exit S on a conveyor belt leading to the varnish spraying operation then to the checking and packaging operations.

Finally, as said above, any of the automatic units described above, can be inserted, as a module, in a traditional line with manual interventions to mechanize this latter in an evolutionary manner.

What is claimed is:

1. An installation for the high-rate production of shoes with bonded-type soles, comprising: a carriage frame; an endless line of carriages supported by said carriage frame, each of said carriages having full lasts thereon; conveying means for moving said carriages in said line; a supply magazine, at a higher level than said line of carriages, for supplying upper and toe assemblies; and including:

(a) means for putting insoles on a last, with automatic selection of foot and size, then centering and attaching on the last;

(b) means for placing upper and toe assemblies from said supply magazine onto the last;

(c) automatic means for gluing and assembling sides of a shoe which have been placed on the line; and (d) automatic means for, successively, overturning a sole which has been brushed, glued and placed on the upper which is still held on its last, reactivating glue, and attaching and bonding of the sole to form a shoe wherein all of the operations are performed continuously.

2. An installation in accordance with claims 1 wherein each of said carriages comprises a plate including:

in the median part, two series of articulated supports for fastening a pair of lasts;

on each side of said supports, areas for placing two soles of different feet;

at the level of one edge, two cams at a distance, one intended to control the change in size, the other the detection of an insole for the right or left foot; and at the level of the opposite edge, two spaced pins making possible the switching of automation signals to the plates of each work station.

3. An installation in accordance with claim 2 wherein said means (a) comprises:

a rotating circular magazine for supplying insoles with automatic operation by a robot provided with n compartments, at constant level, for n sizes, each compartment being double to comprise a stack of insoles for the right foot and a stack of insoles for the left foot;

a flexible tube with suction nozzle for placing an insole on the last;

lateral feeler arms working with clamps and a vertical support rod, to perform centering of the insole on the last;

vertical pneumatic hammers for attaching the insole to the last, previously provided with two barbs, this being done without staples or tacks; and said cams of each carriage for detection of the type of insole and changing of size being operated selectively by stationary feelers, connected to the carriage frame, according to data given on an electro-pneumatic control panel.

4. An installation in accordance with claim 1, wherein said means (c) includes boxing means for placing of glue and pressing of the uppers on the last of an advancing carriage and programmed to automatically operate in sequence with the advancing carriage.

5. An installation in accordance with claim 1 wherein said means (d) includes means for overturning of the sole and an automatic machine comprising:

a unit for centering and attaching of the sole onto the last with a system for automatic registration of the length of the shoe and the height of the sole;

heating elements for reactivation of the glued upper and sole; and a bonding press provided with a flexible membrane enveloping the shoe, this latter being held firmly between rubber clamps during bonding to avoid bursting the membrane.

6. An installation in accordance with claim 5 wherein said centering unit with said system for automatic registration of the dimensions of the sole comprises at least two series of controlled locking-unlocking jacks with coordinated actions, these jacks being connected to the clamps and/or nozzles for positioning and holding of the last.

7. An installation in accordance with claim 1 wherein said carriage frame comprises two horizontal tracks, on which said carriages are movable, located in different planes and all of said means (a)–(d) are disposed opposite the upper one of said tracks, whereby travel on said lower track permits drying and evaporation of the glue, and wherein the installation further includes descent means for lowering said carriages from said upper track to said lower track.

8. An installation in accordance with claim 1 further including varnishing means for varnishing the completed shoe, transport means for transporting the shoes, after removal from their lasts, overhead to said varnishing means, and conveyor belt means for conveying the shoes from said varnishing means to inspection, packaging and storage.

9. An installation in accordance with claim 1 further including air conditioning means for sending cold air over at least a part of the line.

10. An installation in accordance with claim 1 wherein each said means (a)–(d) operates on a single last, except for assemblying the sides, the final production at packaging being performed by pairs of shoes.

11. An installation in accordance with claim 1 wherein each of said means (a)–(d) which are present is doubled to make complete pairs of shoes in all or part of the line.

12. An installation in accordance with claim 1, including:

(e) a series of means for removing the shoe from the last, preparing the last for the following cycle and grasping and transporting the shoe.

13. An installation in accordance with claim 12, wherein said means (e) includes:

a device for swinging the last backward;

a clamp-hammer combination making it possible to pull the shoe by the heel and to lift it and facilitating the push by pressure; and a device with multiple clamps for grasping the shoe, with swinging of the latter 90 degrees and placing on a conveyor.

14. An installation in accordance with claim 1 or claim 12, wherein said means (b) comprises a combination of clamps and a grasping device for the last making possible raising of the last above said carriage, grasping the last by the clamp and pivoting the last 90 degrees, and placing of the upper and toe assembly, supplied from said supply magazine, onto the last, and wherein said supply magazine comprises a circular magazine of uppers, at a higher level than said line of carriages, provided with n compartments corresponding to n different sizes, each compartment being double to comprise stacks for the right foot and left foot and thereby permitting placing of an upper being programmed to fit the insole already attached.

15. An installation in accordance with claim 1 or claim 12, wherein said means (c) comprises a unit, automatic machine for gluing and hammering or "assembly" of the side essentially comprising:

piping for feeding of thermofusible glue;

a group of pneumatic articulated pistons whose ends rest, at programmed rate, on the contour of the lasts by means of a protective skirt; and a device for sending hot air to soften the sides;

whereby said machine makes it possible simultaneously to glue and assemble the sides of two lasts corresponding to a pair of shoes of given size.

16. An installation in accordance with claim 1 or claim 12 and including a means (d), wherein said means (d) includes an overturning means for overturning of the sole comprising:

a first piston horizontally driving the sole on a temporary platform to swing vertically;

clamps for locking the front and back of the sole;

a second piston able to permit swinging of the sole then its transfer, after being overturned, on the appropriate carriage platform.

17. An installation in accordance with claim 1, including:

(f) automatic means for leveling down or "roughing" on the last turned down parts of the toe, back and sides which has been glued and assembled, with preregistration of depth of roughing and electronic feeling of the profile of the sides.

18. An installation in accordance with claim 17 wherein said means (f), wherein said means (d) comprises:

a device for preregistration of the roughing depth;

a station for rough grinding with abrasive belts;

a station for roughing the ends and backs with reversal of the direction of rotation of the belts and driving an abrasive grinder; and a double station (for a pair) for lateral roughing of sides provided with an electronic copier with proximity detector making it possible to follow the profile of the edge of the last and thus eliminate the use of patterns.

* * * * *